US005799513A

United States Patent [19]

Nathan, III et al.

[11] Patent Number: 5,799,513

[45] Date of Patent: Sep. 1, 1998

[54] PERSONAL WATER CRAFT SECURITY DEVICE

[75] Inventors: Simeon Nathan, III, Mesa, Ariz.; Mark S. Brown, Fullerton, Calif.

[73] Assignee: PWC Lock, L.L.C., Mesa, Ariz.

[21] Appl. No.: 711,608

[22] Filed: Sep. 10, 1996

[51] Int. Cl.[6] ..... E05B 73/00

[52] U.S. Cl. ..... 70/14; 70/58; 70/19

[58] Field of Search ..... 70/14, 58, 19, 70/237, 238, 225, 226, 218, 221–223, 231

[56] References Cited

U.S. PATENT DOCUMENTS 5,253,497 10/1993 Hsien ..... 70/238

5,277,042 1/1994 Tobias ..... 70/209

5,440,908 8/1995 Lin ..... 70/209

5,555,753 9/1996 Matlock ..... 70/209

*Primary Examiner*—Steven N. Meyers

*Assistant Examiner*—Tuyet-Phuong Pham

*Attorney, Agent, or Firm*—Snell & Wilmer, L.L.P.

[57] ABSTRACT

A security device for personal water craft (PWC) includes a crossbar adapted to cooperate with a trailer component, a securing arm capable of coupling to the crossbar, and a lock mechanism for coupling the securing arm to the crossbar such that translational displacement of the securing arm relative to the crossbar is restricted in at least one direction. The security device couples a PWC to its trailer and prevents unauthorized removal of the PWC from the trailer.

8 Claims, 7 Drawing Sheets

PERSONAL WATER CRAFT SECURITY DEVICE

FIELD OF THE INVENTION

The present invention relates generally to vehicle security systems. In particular, the present invention relates to a portable locking device for personal water craft.

BACKGROUND OF THE INVENTION

Personal water craft (PWC) are small water vessels typically sized to accommodate one operator or one operator along with one or two passengers. PWC have become very popular in recent years due to their relatively inexpensive cost (compared to conventional marine vessels), compact size, and ease of use. Currently, approximately twenty percent of all water craft registered in the United States are PWC, and this percentage continues to grow steadily.

Due in part to their popularity, small size, and relatively light weight, PWC are frequently stolen. Indeed, current statistics show that PWC account for approximately seventy percent of all water vessel thefts. PWC are often stolen directly from their trailers, which support the PWC with parallel runners. The design of such trailers makes PWC thefts easy if the PWC is not secured to the trailer - a thief need only slide the PWC off of the runners. In an attempt to deter such thefts, many PWC trailers utilize unsophisticated cable restraints or strapping systems that provide little, if any, meaningful protection against theft. Such systems are more typically designed to prevent the PWC from falling off of the trailer during transport rather than to prevent theft.

Presently known strapping systems that merely bind a PWC to a trailer can be easily removed, severed, or loosened to the point where the PWC can be taken from the trailer. Other known devices include a length of cable attached to the trailer and having a hook configured to engage with an eyelet or some other component of the PWC. The opposing end of the cable may be attached to the trailer via a winch or other device that collects slack in the cable. Unfortunately, such cables are usually exposed and can be easily tampered with. Thus, such cables can be severed quickly to facilitate removal of the PWC from the trailer.

Although some PWC security systems may provide increased theft protection over conventional cable systems or hold-down devices, such security systems may be bulky and difficult to install and remove from the PWC or the PWC trailer. In addition, typical consumers concerned with deterring casual theft by amateurs may not be motivated to invest in a robust and costly PWC security system designed to completely eliminate the likelihood of theft.

SUMMARY OF THE INVENTION

Accordingly, it is an advantage of the present invention that an improved security device for personal water craft (PWC) is provided.

Another advantage is that the present invention can be employed with most conventional PWC trailers to deter PWC theft.

Another advantage is that the present invention provides increased PWC security over conventional cable lock and strapping systems utilized with PWC trailers.

A further advantage is that a PWC security device in accordance with the present invention is difficult to tamper with when installed on a PWC trailer.

Another advantage is that the present invention provides a portable and relatively inexpensive PWC security device that is convenient to use.

The above and other advantages of the present invention are carried out in one form by an apparatus for securing a PWC to a trailer configured to support the PWC. The apparatus includes a crossbar adapted to cooperate with a trailer component, a securing arm having a first portion adapted to removably couple to a PWC component, and a lock mechanism for locking the securing arm to the crossbar such that translational displacement of the securing arm relative to the crossbar is restricted in at least one direction.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
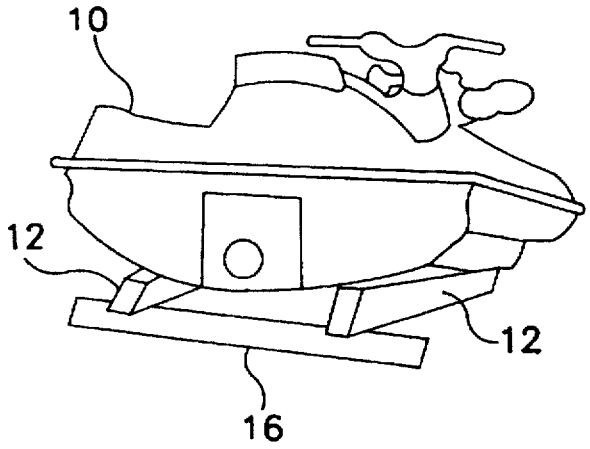
FIG. 1 shows an exemplary personal water craft (PWC) for which the present invention may be utilized.
Figure 2:
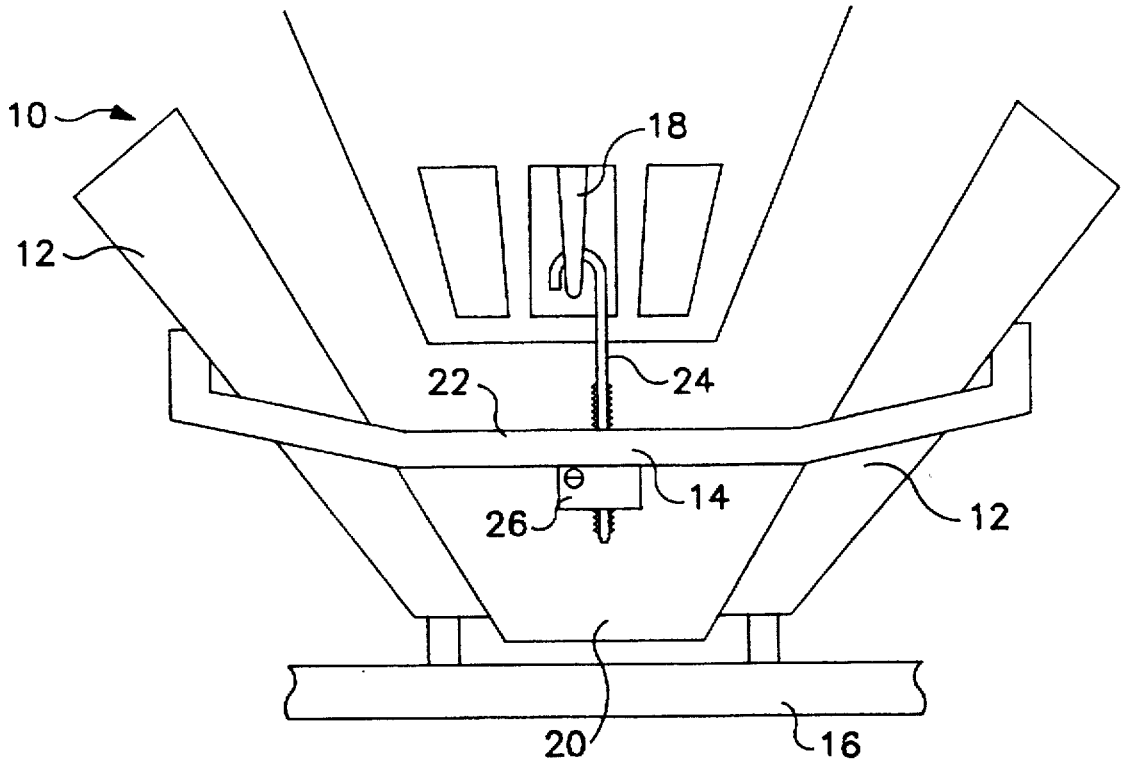
FIG. 2 shows a security device installed upon a PWC.

FIG. 1 shows an exemplary personal water craft (PWC) 10 resting upon parallel trailer runners 12 that are conventionally utilized with PWC trailers (not shown). An operator slides PWC 10 along trailer runners 12 to quickly and easily load or unload PWC 10. FIG. 2 shows PWC 10 secured to a trailer via a PWC security device 14. PWC security device 14 couples PWC 10 to trailer runners 12 and prevents removal of PWC 10 from the trailer by restricting movement of PWC 10 beyond a runner support frame 16. Accordingly, removal of PWC 10 from the trailer is not possible unless PWC 10, PWC security device 14, or the trailer is disassembled or damaged. It should be appreciated that the particular embodiment of PWC 10 shown in FIG. 1 is illustrative only, and that the present invention may be configured for compatibility with a variety of different PWC.

Figure 3:
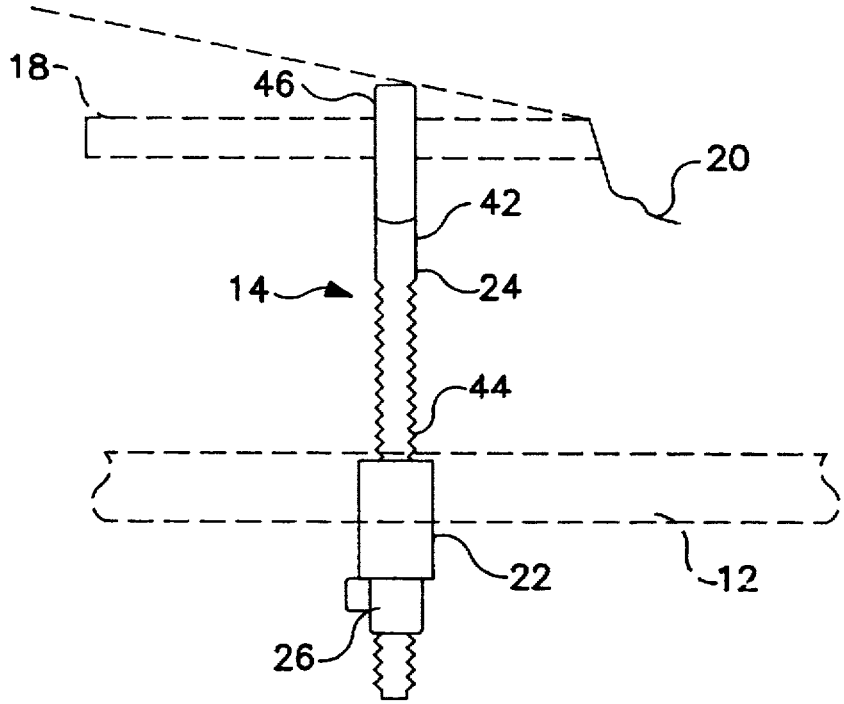
FIG. 3 is a side view of the security device shown in FIG. 2.

As shown in FIGS. 2 and 3, PWC security device 14 is suitably configured to engage trailer runners 12 and the driveshaft 18 of PWC 10. PWC security device 14 may be alternately configured to cooperate with any suitable trailer component, e.g., the trailer frame, runner support frame 16, suspension elements, or structures specifically adapted for use with PWC security device 14. Furthermore, PWC security device 14 may engage any suitable component located upon PWC 10, e.g., portions of the hull 20, engine components, or the like.

Figure 4:
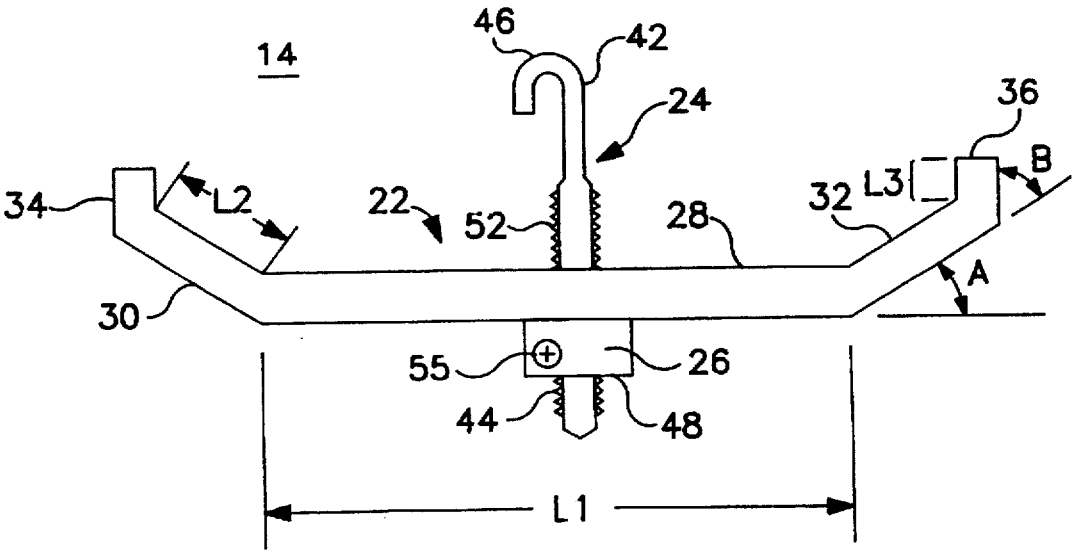
FIG. 4 is a front view of the security device shown in FIG. 2.
Figure 5:
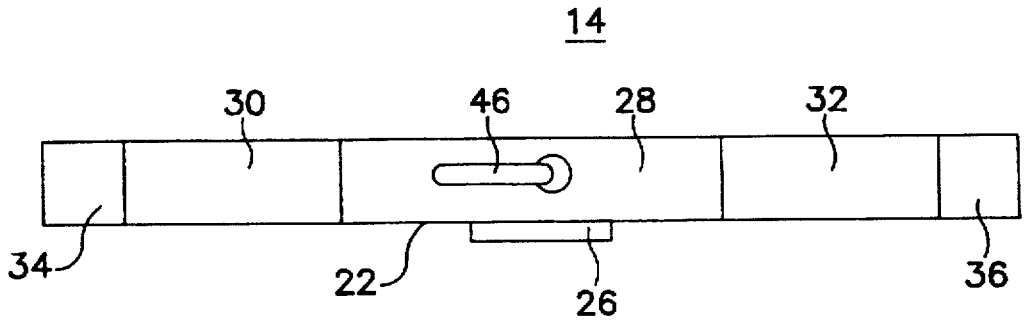
FIG. 5 is a top view of the security device shown in FIG. 2.

With reference to FIGS. 4 and 5, PWC security device 14 generally includes a crossbar 22, a securing arm 24, and a lock mechanism 26. Securing arm 24 couples to crossbar 22 via lock mechanism 26, which restricts upward movement of securing arm 24 relative to crossbar 22 when engaged.

Crossbar 22 is preferably formed from an approximately 25 mm ×38 mm rectangular steel tube. Crossbar 22 is preferably formed from steel tubing having a wall thickness between 2 mm and 4 mm. Any suitable material may be employed, and crossbar 22 is not limited to any specific cross sectional configuration. For example, crossbar 22 may be formed from a solid bar or have a square, round, triangular, or any suitable cross section. Crossbar 22 (and other elements of PWC security device 14) may be painted, powder coated, or otherwise treated to provide corrosion resistance or aesthetic appeal. In addition, portions of crossbar 22 (and other elements of PWC security device 14) may be covered with a protective sleeve (not shown) formed from rubber, vinyl, plastic, or the like.

Crossbar 22 preferably includes a central portion 28, opposing first and second end portions 30, 32, and opposing first and second tip portions 34, 36. End portions 30, 32 are tapered relative to central portion 28 to thereby form respective angles with central portion 28. Although not a requirement of the present invention, end portions 30, 32 are tapered at approximately the same angle A. Tip portions 34, 36 are similarly tapered at approximately the same angle B relative to end portions 30, 32, respectively. In the preferred embodiment, angle A is roughly 20 degrees and angle B is roughly 70 degrees. These angles are exemplary and are not intended to limit the scope of the present invention.

Crossbar 22 is configured to substantially follow the contour of trailer runners 12. The upward tapering of crossbar 22 is desirable to limit rotation of crossbar 22 about the axis generally defined by securing arm 24 when PWC security device 14 is in use. Rotation of crossbar 22 is limited by end portions 30, 32 and/or tip portions 34, 36, which abut and engage trailer runners 12 when excessively rotated. Thus, the tapered configuration of crossbar 22 prevents removal of PWC security device 14 from trailer runners 12.

Crossbar 22 is suitably sized to be compatible with most conventional PWC trailers utilizing trailer runners 12. In an exemplary embodiment, central portion 28 is approximately 250 mm to 350 mm long, and preferably about 305 mm long (indicated by the reference L1 in FIG. 4), end portions 30, 32 are each approximately 150 mm to 200 mm long, and preferably about 173 mm long (indicated by the reference L2), and tip portions 34, 36 are each approximately 20 mm to 50 mm long, and preferably about 35 mm long (indicated by the reference L3).

In an alternate embodiment (not shown), central portion 28 is approximately 356 mm long and end portions 30, 32 are each approximately perpendicular to central portion 28. This embodiment need not employ tip portions 34, 36. Those skilled in the art will recognize that crossbar 22 may be appropriately configured according to the particular application.

Figure 6:
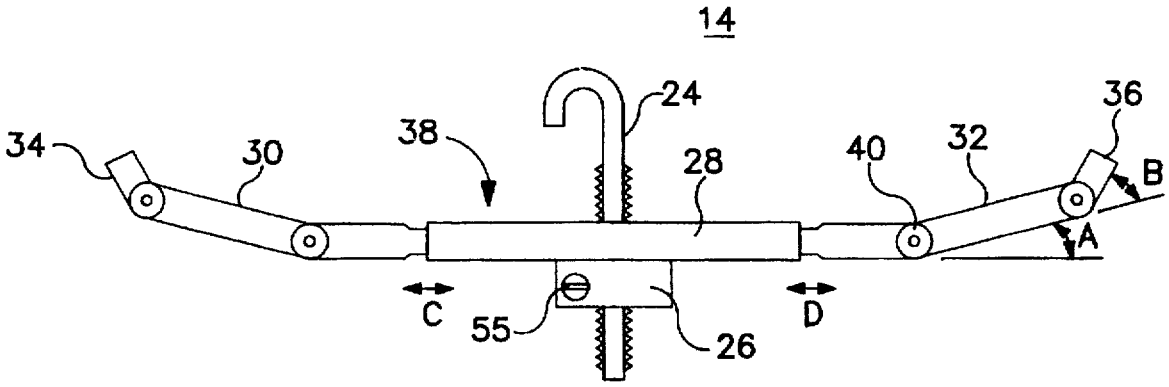
FIG. 6 shows a security device according to an alternate embodiment of the present invention.

Referring now to FIG. 6, a further embodiment of the present invention incorporates an adjustable crossbar 38. Crossbar 38 is desirable to enable PWC security device 14 to adapt to a large number of PWC trailers. Crossbar 38 may be configured such that the angle between central portion 28 and at least one end portion 30, 32 is adjustable (as indicated by arrow A). Similarly, the angle between at least one end portion 30, 32 and the associated tip portion 34, 36 may be adjustable (as indicated by arrow B). The angular adjustability of crossbar 38 may be achieved through the use cf locking hinges 40 or any suitable mechanism.

The length of crossbar 38 may also be adjustable, as indicated by arrows C and D in FIG. 6. For example, central portion 28 may be extensible via telescopic or threaded elements or any suitable adjustment mechanism known to those skilled in the art. Although FIG. 6 shows only central portion 28 having a variable length, end portions 30, 32 and tip portions 34, 36 may also be configured such that their respective lengths are adjustable.

Referring again to FIGS. 3 and 4, securing arm 24 engages crossbar 22 during use. Securing arm 24 is preferably formed from a sufficiently strong and durable material, such as hardened steel. In the preferred embodiment, securing arm 24 is round and has a diameter of approximately 16 mm. It should be appreciated that securing arm 24 need not be round, i.e., securing arm 24 may have any suitable cross sectional configuration. To facilitate easy installation and removal of PWC security device 14, securing arm 24 is preferably removable from crossbar 22. When installed, securing arm 24 is roughly perpendicular to central portion 28 of crossbar 22.

Securing arm 24 includes a first portion 42, adapted to removably couple to driveshaft 18 (see FIGS. 2 and 3), and a second portion 44 that is received by crossbar 22. First portion 42 preferably includes an integral arcuate end 46 configured to receive driveshaft 18. Arcuate end 46 is positioned over driveshaft 18 during installation of PWC security device 14. In the embodiment shown, the curvature of arcuate end 46 is formed with an inner radius of approximately 16 mm. It should be appreciated that first portion 42 may be alternatively shaped to engage other PWC components or to be compatible with the specific shape and size of driveshaft 18. Furthermore, the diameter of first portion 42 may differ from the diameter of the remainder of securing arm 24 according to the amount of clearance between driveshaft 18 and hull 20 (see FIG. 3).

As an alternative to arcuate end 46, PWC security device 14 may employ any component capable of suitably engaging driveshaft 18. For example, securing arm 24 may include a clamping device (not shown) coupled thereto that engages driveshaft 18 in response to upward movement of securing arm 24 relative to driveshaft 18. Such a clamping device may be desirable to facilitate easy installation of securing arm 24. Furthermore, nothing requires that arcuate end 46 (or an equivalent engaging device) be an integral part of securing arm 24.

Securing arm 24 couples to crossbar 22 via lock mechanism 26. In the embodiment shown in FIGS. 2–5, lock mechanism 26 is attached to crossbar 22. However, the present invention also contemplates the use of alternative lock mechanisms (described below) that may be discrete from crossbar 22. In addition, while securing arm 24 is preferably inserted through crossbar 22, lock mechanism 26 may be alternately configured such that securing arm 24 engages lock mechanism 26 while bypassing crossbar 22.

Lock mechanism 26 couples securing arm 24 to crossbar 22 such that translational displacement of securing arm 24 relative to crossbar 22 is restricted in at least one direction. In particular, downward movement of crossbar 22, relative to securing arm 24, is restricted when PWC security device 14 is in use. Thus, when installed, upward movement of crossbar 22, relative to securing arm 24, is limited by trailer runners 12 and crossbar 22 is preferably maintained adjacent trailer runners 12 via lock mechanism 26. Of course, nothing prevents PWC security device 14 from utilizing a locking device that limits translational movement of securing arm in more than one direction.

Figure 7:
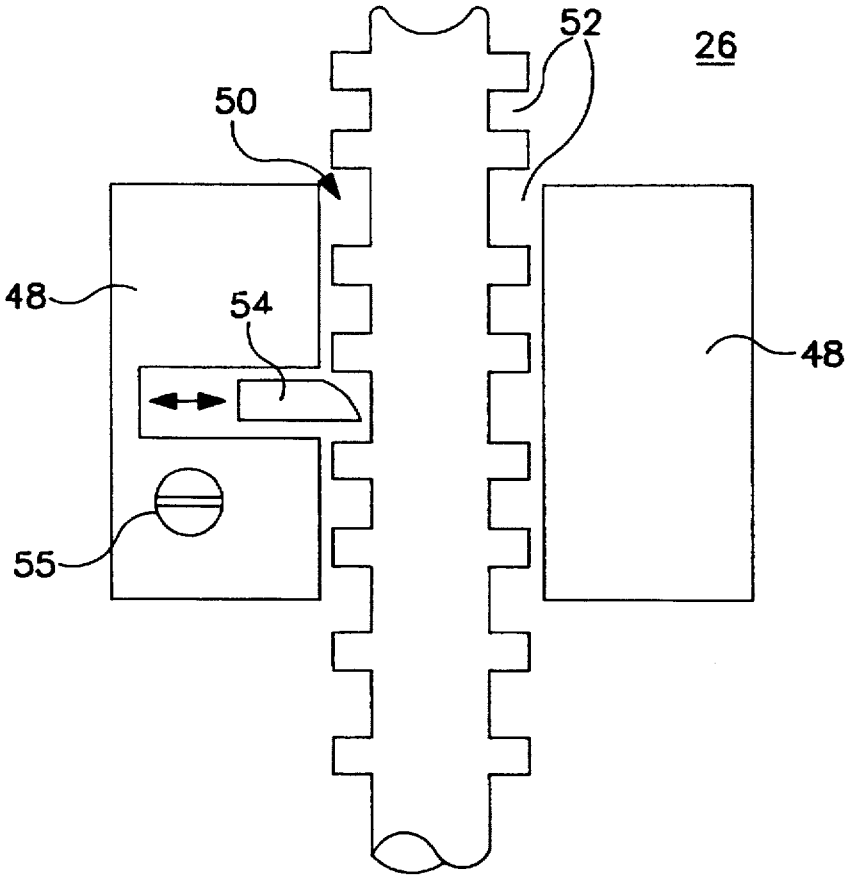
FIG. 7 is a schematic cross sectional representation of a lock mechanism employed by the security device shown in FIG. 2.

Although PWC security device 14 may incorporate any number of locking devices known to those skilled in the art, a preferred embodiment utilizes lock mechanism 26 (generally depicted in FIGS. 2–5 and schematically represented in FIG. 7). Lock mechanism 26 includes a housing 48 that is preferably, but need not be, attached to crossbar 22. A hole 50 formed within housing 48 is configured to receive second portion 44 of securing arm 24.

Second portion 44 preferably includes a plurality of integral notches 52 configured to cooperate with a latch 54 located within housing 48. Although the preferred embodiment utilized notches spaced at approximately 6.5 mm intervals, notches 54 may be arranged to provide any desirable step size. Latch 54 is configured to engage notches 52 within hole 50 to maintain the position of securing arm 24 relative to crossbar 22.

According to a preferred aspect of the present invention, lock mechanism 26 is self-locking, i.e., a user may freely move crossbar 22 upward relative to securing arm 24 and lock mechanism 26 automatically engages to prevent downward motion of crossbar 22 relative to securing arm 24. Latch 54 may be tapered (as shown in FIG. 7) to facilitate such self-locking.

Lock mechanism 26 must be disabled to release crossbar 22 from securing arm 24. The exemplary embodiment shown in FIGS. 2–5 utilizes a key release element 55 integral to lock mechanism 26. However, PWC security device 14 may alternatively incorporate any suitable release device such as a combination tumbler, a keypad, or the like.

Figure 8:
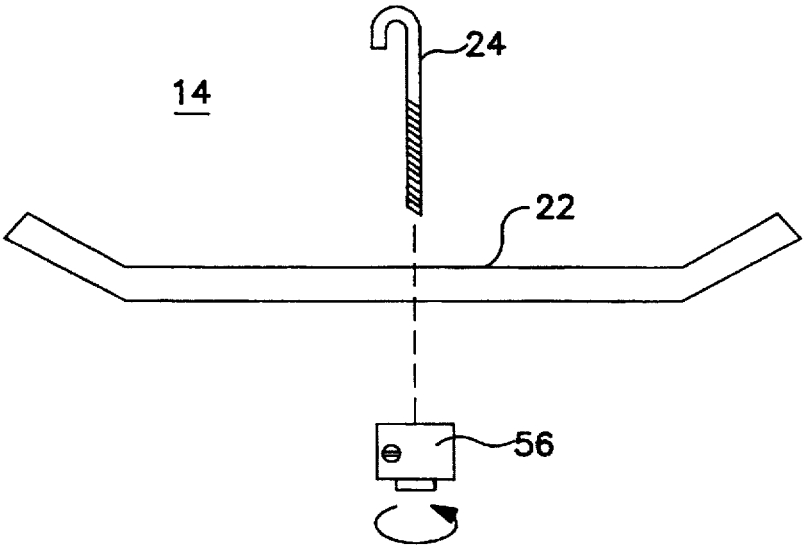
FIG. 8 shows a security device according to an alternate embodiment of the present invention.

An alternate embodiment of PWC security device 14 includes a threaded lock mechanism 56 (see FIG. 8). This embodiment utilized a securing arm 24 having a threaded second portion 44 rather than notches 52 located on second portion 44. Lock mechanism 56 is configured to threadably engage second portion 44 to urge crossbar 22 toward first portion 42 of securing arm 24. Once installed, lock mechanism 56 may not be removed from securing arm 24 unless disengaged via the appropriate key, combination, or other access element.

Figure 9:
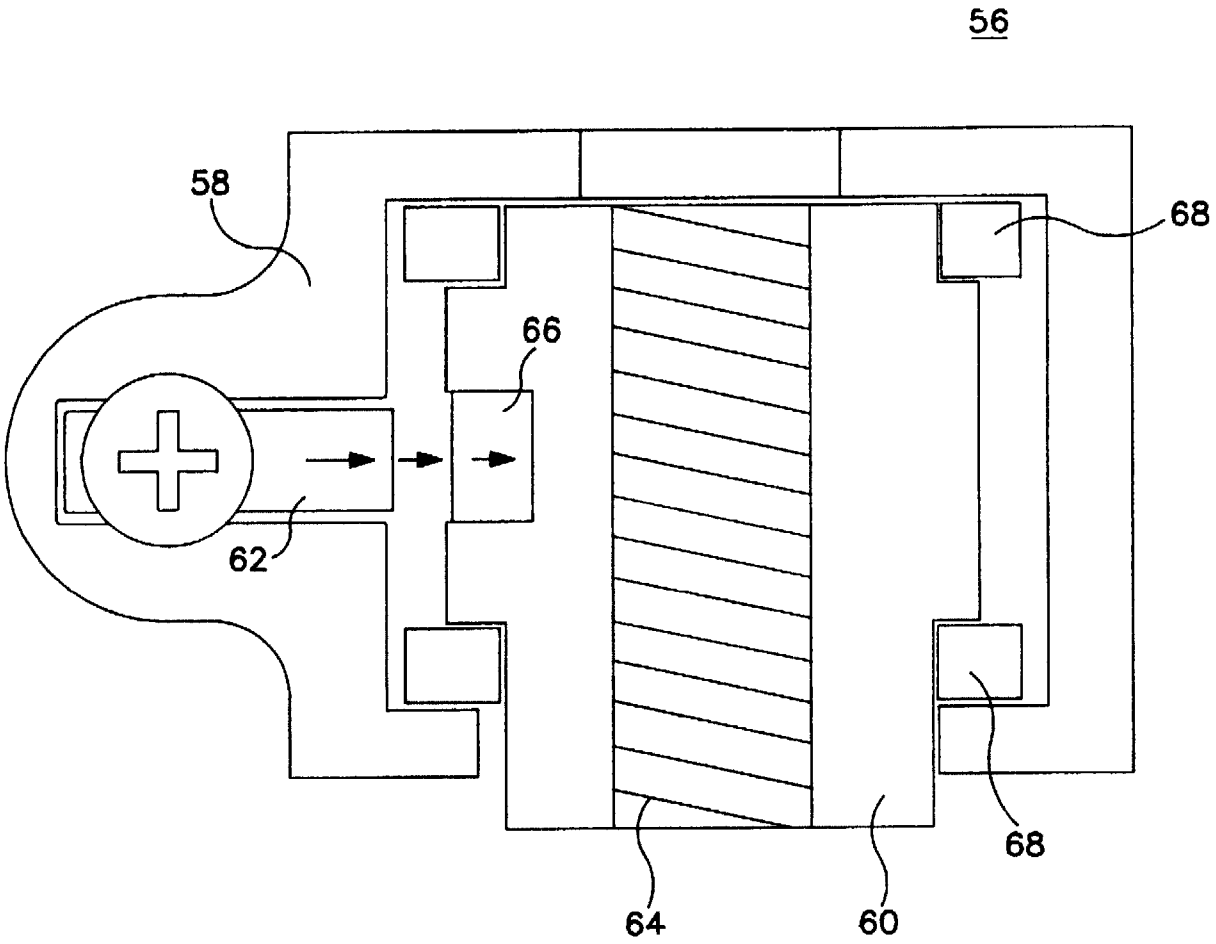
FIG. 9 is a schematic cross sectional representation of a lock mechanism employed by the security device shown in FIG. 8.

As shown in FIG. 9, lock mechanism 56 suitably includes an outer housing 58, an inner collar 60 located within outer housing 58, and an engagement rod 62. Inner collar 60 has internal threads 64 configured to engage the threads formed on second portion 44 of securing arm 24. The exterior of inner collar 60 may include a groove 66 sized to receive engagement rod 62. Engagement rod 62 and groove 66 cooperate to releasably couple outer housing 58 to inner collar 60. As depicted by the arrows in FIG. 9, a user may utilize a key (or an alternate security element) to urge engagement rod 62 into groove 66. In place of engagement rod 62, PWC security device 14 may employ any suitable coupling element known to those skilled in the art.

When outer housing 58 is coupled to inner collar 60, inner collar 60 rotates with outer housing 58 to facilitate threadable engagement of lock mechanism 56 with second portion 44 of securing arm 24. On the other hand, outer housing 58 rotates independent of inner collar 60 when outer housing 58 is not coupled to inner collar. Lock mechanism 56 may include a number of bearings 68 to facilitate rotation of inner collar 60 relative to outer housing 58.

During installation of this alternate embodiment of PWC security device 14, a user threads lock mechanism 56 onto securing arm 24 until crossbar 22 is suitably positioned. Next, the user manipulates lock mechanism 56 to decouple outer housing 58 from inner collar 60. After such manipulation of lock mechanism 56, inner collar 60 maintains its position relative to securing arm 24 while outer housing 58 is free to rotate about inner collar 60.

Figure 10:
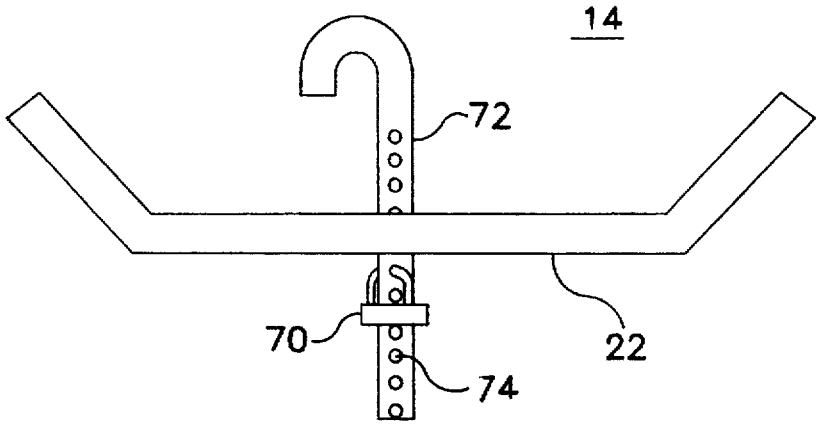
FIG. 10 shows a security device according to an alternate embodiment of the present invention.

PWC security device 14 is not limited to any specific locking component; any locking structure known in the art may be suitable for use with the present invention. For example, PWC security device 14 may alternatively employ a conventional padlock 70 or equivalent securing device in conjunction with a securing arm 72 that includes a number of adjustment holes 74 formed therein (see FIG. 10). In addition, nothing requires that PWC security device 14 implement a locking mechanism discrete from crossbar 22, e.g., a suitable locking mechanism may be integrated within the structure of crossbar 22.

Figure 11:
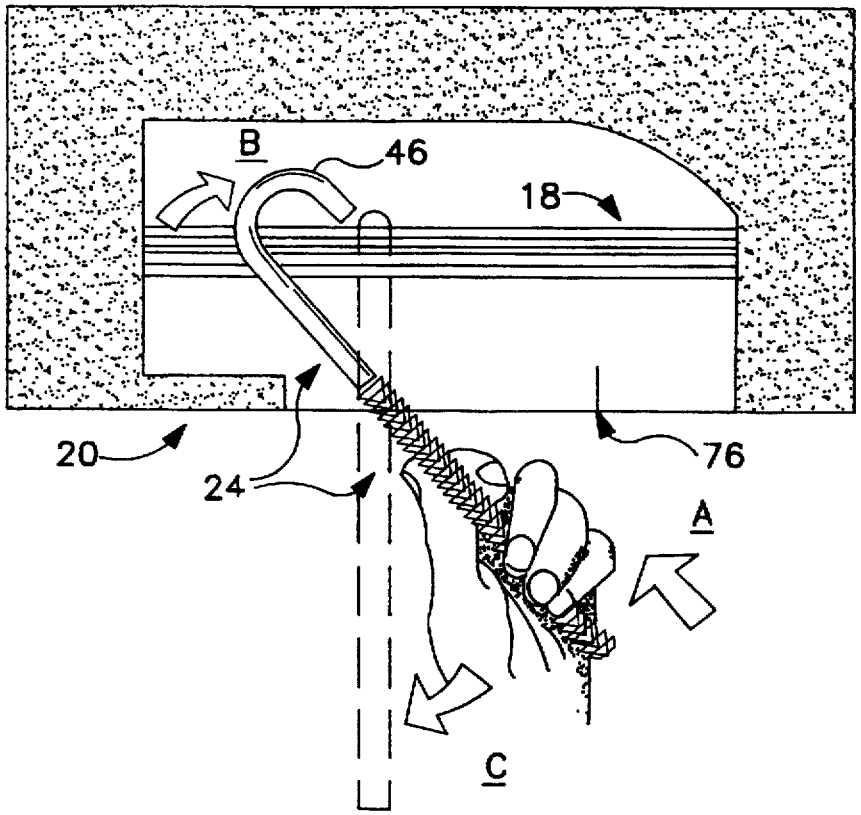
FIG. 11 illustrates an exemplary installation of a securing arm employed by the security device shown in FIG. 2.

Referring to FIGS. 2. 3, and 11, an exemplary installation of PWC security device 14 will be described. To install the embodiment shown in FIGS. 2–5, securing arm 24 is initially removed from crossbar 22 to facilitate easy manipulation of arcuate end 46 over driveshaft 18. FIG. 11 depicts an exemplary installation of securing arm 24 over driveshaft 18. Typically, driveshaft 18 is located within a cavity 76 formed within hull 20 of PWC 10. Thus, securing arm 24 is initially inserted into cavity 76 (indicated by arrow A in FIG. 11). Next, securing arm 24 is twisted such that arcuate end 46 engages driveshaft 18 (indicated by arrow B in FIG. 11). After arcuate end 46 is properly engaged, securing arm 24 is positioned in a relatively vertical position and moved toward the front of PWC 10 (indicated by arrow C in FIG. 11).

As depicted in FIGS. 3 and 11, the clearance between hull 20 and driveshaft 18 within cavity 76 may vary along the length of driveshaft 18. Preferably, securing arm 24 is eventually positioned such that the top of arcuate end 46 is approximately adjacent to hull 20. Such positioning enables hull 20 to effectively limit upward movement of securing arm 24 during installation of crossbar 22.

Next, crossbar 22 is positioned upon securing arm 24. As described above, crossbar 22 and lock mechanism 26 are preferably coupled together to suitably receive securing arm 24. Assuming that the configuration of crossbar 22 is suited to the particular application, the user guides crossbar 22 upward while maintaining crossbar 22 roughly perpendicular to trailer runners 12. Such perpendicular positioning is desirable to ensure that end portions 30, 32 and tip portions 34, 36 effectively cooperate with trailer runners 12. As shown in FIG. 2, arcuate end 46 cooperates with crossbar 22 to couple PWC 10 to the PWC trailer.

In summary, the present invention provides an improved security device for use with PWC. The PWC security device can be employed with most conventional PWC trailers to deter theft of the PWC. A PWC security device according to the present invention provides increased security over conventional cable lock and strapping systems utilized with PWC trailers. The PWC security device is portable, inexpensive, convenient to use, and difficult to tamper with when properly installed.

The present invention has been described with reference to preferred embodiments. Descriptive terms such as "upward," "top," and "below" have been utilized herein for illustrative purposes and to maintain consistency with the Figures. Such terms are not intended to limit the scope of the present invention. Furthermore, those skilled in the art will recognize that changes difications may be made to the preferred embodiments without departing from the scope present invention. These and other changes and modifications are intended to be included the scope of the present invention, as expressed in the following claims.

What is claimed is:

1. An apparatus for securing a personal water craft (PWC) to a trailer configured to support said PWC, said apparatus comprising:

a first member comprising a crossbar, wherein said crossbar comprises a central portion and first and second opposing end portions coupled to said central portion, each of said first and second end portions forming an angle with said central portion;

a second member comprising a securing arm having a first portion for removably coupling to a PWC component and a second portion for coupling to said first member, wherein each of said first and second end portions of said first member are angled toward said first portion when said second portion is coupled to said first member;

means for locking said second member to said first member such that translational displacement of said second member relative to said first member is restricted in at least one direction; wherein said securing arm further comprises a threaded portion;

said means for locking is configured to threadably engage said threaded portion of said securing arm to thereby urge said crossbar toward said first portion of said securing arm;

said means for locking comprises an outer housing, an inner collar located within said outer housing and having internal threads formed therein to engage said threaded portion of said securing arm, and means for releasably coupling said outer housing to said inner collar;

said inner collar rotates with said outer housing to facilitate threadable engagement of said means for locking with said threaded portion of said securing arm when said outer housing is coupled to said inner collar; and said outer housing rotates independent of said inner collar when said outer housing is not coupled to said inner collar.

2. An apparatus according to claim 1, wherein said crossbar further comprises opposing first and second tip portions, each of said first and second tip portions being angled relative to said first and second end portions, respectively, and said first and second tip portions are angled toward said first portion of said second member.

3. An apparatus according to claim 1, wherein said second member includes an arcuate end configured to receive said PWC component.

4. A security device for personal water craft (PWC), said security device comprising:

a crossbar, wherein said crossbar comprises a central portion and first and second opposing end portions coupled to said central portion, each of said first and second end portions forming an angle with said central portion and angled toward a first portion of a securing arm;

said first portion of said securing arm being adapted to couple to a PWC component and said securing arm having a second portion in communication with said crossbar;

means for locking said second portion of said securing arm to said crossbar such that translational displacement of said securing arm relative to said crossbar is restricted in at least one direction, wherein said means for locking is integral to said crossbar; wherein said securing arm further comprises a threaded second portion;

said means for locking is configured to threadably engage said second portion of said securing arm to thereby urge said crossbar toward said first portion of said securing arm;

said means for locking comprises an outer housing, an inner collar located within said outer housing and having internal threads formed therein to engage said second portion of said securing arm, and means for releasably coupling said outer housing to said inner collar; and said inner collar rotates with said outer housing to facilitate threadable engagement of said means for locking with said second portion of said securing arm when said outer housing is coupled to said inner collar.

5. An apparatus according to claim 4, wherein said crossbar further comprises opposing first and second tip portions, each of said first and second tip portions forming an angle with said first and second end portions, respectively.

6. An apparatus for securing a personal water craft (PWC) to a trailer configured to support said PWC, said apparatus comprising:

a crossbar comprising a central portion and first and second opposing end portions coupled to said central portion, each of said first and second end portions forming an angle with said central portion and angled toward an upper portion of a securing arm, said securing arm having a lower portion capable of coupling to said crossbar;

means for engaging a PWC component, said means for engaging being located on said upper portion of said securing arm;

means for restricting translational displacement of said securing arm relative to said crossbar in at least one direction; wherein said means for engaging cooperates with said crossbar to couple said PWC to said trailer;

said securing arm comprises a threaded portion;

said means for restricting comprises an outer housing, an inner collar located within said outer housing and having internal threads formed therein to engage said lower portion of said securing arm, and means for releasably coupling said outer housing to said inner collar; and said inner collar rotates with said outer housing to facilitate threadable engagement of said means for restricting with said lower portion of said securing arm when said outer housing is coupled to said inner collar.

7. An apparatus according to claim 6, wherein said means for restricting is integral to said crossbar.

8. An apparatus according to claim 7, wherein said means for restricting is positioned between said crossbar and said means for engaging.

* * * * *